US005320573A

United States Patent [19]

Matsuyama

[11] Patent Number: 5,320,573

[45] Date of Patent: Jun. 14, 1994

[54] SPIRAL SPRING TOY WITH A PULLING STRING

[75] Inventor: Yasushi Matsuyama, Tokyo, Japan

[73] Assignee: Tomy Company, Ltd., Tokyo, Japan

[21] Appl. No.: 895,713

[22] Filed: Jun. 9, 1992

[30] Foreign Application Priority Data

Jun. 11, 1991 [JP] Japan ..... 3-52349

[51] Int. Cl.[5] ..... A63H 13/00

[52] U.S. Cl. ..... 446/358; 446/227; 446/298; 185/DIG. 1; 242/107

[58] Field of Search ..... 446/191, 193, 229, 241, 446/247, 248, 249, 250, 251, 252, 404, 408, 297, 298, 300, 301, 302, 303, 464, 358, 227, 41; 434/159, 167, 174; 273/141 R, 143 R; 185/37, 39, 45, DIG. 1; 242/107

[56] References Cited

U.S. PATENT DOCUMENTS

| | | | |
|---|---|---|---|
| 3,603,029 | 9/1971 | Nutting | 446/191 |
| 3,945,146 | 3/1976 | Brown | 446/249 |
| 4,028,843 | 6/1977 | Appel | 446/249 |
| 4,050,342 | 9/1977 | Suzuki | 446/298 |
| 4,391,064 | 7/1983 | Lakin | 446/227 |
| 4,795,395 | 1/1989 | Oishi | 446/303 |

*Primary Examiner*—Robert A. Hafer
*Assistant Examiner*—David Kenealy
*Attorney, Agent, or Firm*—Staas & Halsey

[57] ABSTRACT

A spiral spring toy having a pulling string, a string windup spiral spring, first and second turning bodies, a driving spiral spring, a spiral-shaped guide groove and a floating means. The first turning body is connected with the driving spiral spring so that the driving spiral string biases the first turning body in a first rotational direction and rotation of the first turning body in a second rotational direction charges the driving spiral spring. The second turning body is connected with the pulling string and the string windup spiral spring so that the string windup spiral spring biases the second turning body in the first rotational direction. When the pulling string is pulled, the second turning body rotates in the second rotational direction and charges the string windup spiral spring. The spiral-shaped guide groove has an end portion and is provided on either the first or the second turning body. The floating means is provided on the turning body not provided with the spiral-shaped guide groove so that when the pulling string is pulled, the floating means contacts the end portion of the spiral-shaped guide groove causing the first and second turning body to rotate integrally in the second rotational direction. When the pulling string is released, the floating means floats through and copies the spiral-shaped guide groove so that the second turning body is restored before the first turning body and the string windup spiral spring is discharged before the driving spiral spring.

20 Claims, 9 Drawing Sheets

SPIRAL SPRING TOY WITH A PULLING STRING

BACKGROUND OF THE INVENTION

1. Field of the Invention

The present invention relates to a spiral spring toy with a pulling string which includes a driving spiral spring charged by pulling the pulling string.

2. Description of the Related Art

Laid-open Japanese Utility Model Application 02-17192 is an example of a conventional spiral spring toy with the pulling string. The toy described in the Japanese Application has a driving spiral spring which is charged by pulling the pulling string. Various motions of the toy are thereafter actuated by the energy charged in the driving spiral spring.

However, in the above-described conventional spiral spring toy with a pulling string, the string which has been pulled to charge the driving spiral spring is gradually wound up onto a pulley by virtue of a restoration force of the driving spiral spring. Therefore, the following problems were encountered.

An unexpected dangerous condition could occur if the spiral spring toy with the string is installed on a crib, for example, and one who is other than a baby charges the driving spiral spring by pulling the string to therefore cause the toy to move in its predetermined motion, or play its music. When a conventional toy is used in this manner, the string could become entangled with a part of the baby's body when the string is rewound onto the pulley. On the other hand, shortening the length of the string to avoid this danger reduces the charge amount and, as a result, the operating time of the toy is undesirably reduced by a corresponding amount.

Moreover, if the spiral spring toy with a pulling string is hung from the ceiling, while the string is being rewound onto the pulley, the string is suspended, thus becoming an obstruction when someone passes closely, detracting from the appearance of the toy.

Furthermore, if the spiral spring toy with a pulling string is embodied as a walking toy or a travelling toy, the toy walks or travels while dragging the string. Here too, the string detracts from the appearance.

SUMMARY OF THE INVENTION

An object of the present invention is to provide a spiral spring toy with a pulling string which is superior in safety and appearance.

The above-mentioned objects of the present invention are accomplished by providing a spiral spring toy having a pulling string, a string windup spiral spring, first and second turning bodies, a driving spiral spring, a spiral-shaped guide groove and a floating means. The first turning body is connected with the driving spiral spring so that the driving spiral string biases the first turning body in a first rotational direction and rotation of the first turning body in a second rotational direction charges the driving spiral spring. The second turning body is connected with the pulling string and the string windup spiral spring so that the string windup spiral spring biases the second turning body in the first rotational direction. When the pulling string is pulled, the second turning body rotates in the second rotational direction and charges the string windup spiral spring. The spiral-shaped guide groove has an end portion and is provided on either the first or the second turning body. The floating means is provided on the turning body not provided with the spiral-shaped guide groove so that, when the pulling string is pulled, the floating means contacts the end portion of the spiral-shaped guide groove causing the first and second turning body to rotate integrally in the second rotational direction. When the pulling string is released, the floating means floats through and copies the spiral-shaped guide groove so that the second turning body is restored before the first turning body, thereby discharging the string windup spiral spring before the driving spiral spring.

In accordance with the present invention, when the string is released after charging is completed, the second turning body is restored earlier than the first turning body by virtue of the copying motion of the floating member through the spiral-shaped guide groove. The string is immediately retracted into the housing main body due to this early rewinding motion. Accordingly, if the spiral spring toy with a pulling string of the present invention is hung on a crib, the string is prevented from entangling with a part of the baby's body during its operation because the string is quickly retracted into the housing main body. Moreover, if the spiral spring toy with a pulling string is hung from the ceiling, the string does not hang from the toy while the toy is operating. The string is no longer an obstruction to someone passing closely and it does not destroy the appearance of the toy. Similar advantages are attained when the present invention is applied to a walking toy or a travelling toy.

DESCRIPTION OF THE PREFERRED EMBODIMENT

Figure 1:
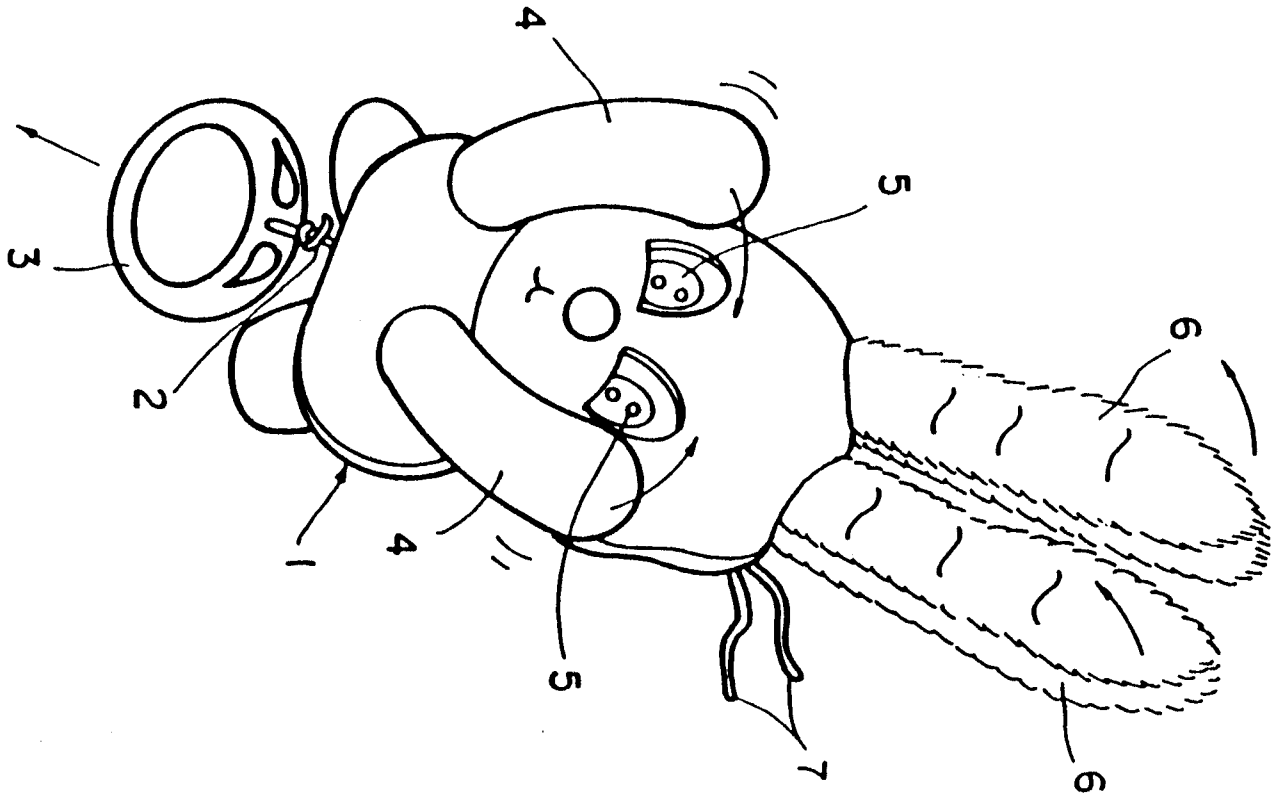
FIG. 1 is a perspective view of a spiral spring toy with a pulling string according to the present invention.

Hereinafter, referring to the drawings, the embodiment of the spiral spring toy with a pulling string in accordance with the present invention is explained.

The spiral spring toy with a pulling string of the present invention is shown as a bunny-type doll in FIG. 1. It has a string 2 slightly pulled out from the crotch of the doll body 1. The string is provided with a handle 3 at a tip end of the string 2. The invention operates so that when the handle 3 is released after the handle 3 has been pulled downward, the doll body 1 performs a predetermined motion or speaks. Specifically, a pair of paws 4 make a peek-a-boo motion, eyes 5 move in a right-and-left direction and ears 6 rise and fall. Moreover, at the same time, the present invention makes a sound of a flute resembling a sound of the "peek-a-boo".

In performing these motions, when a paw is released from the handle 3, the handle 3 returns immediately to an initial position. That is, the string 1 which has been pulled out from the doll body 1 is retracted into the doll body 1 before the doll body I begins to move and speak.

On the back of the doll body 1, an attached string 7 is provided for hanging the doll body 1 on a bed or wall.

Next, the internal mechanism of the doll body 1 is explained.

Figure 2:
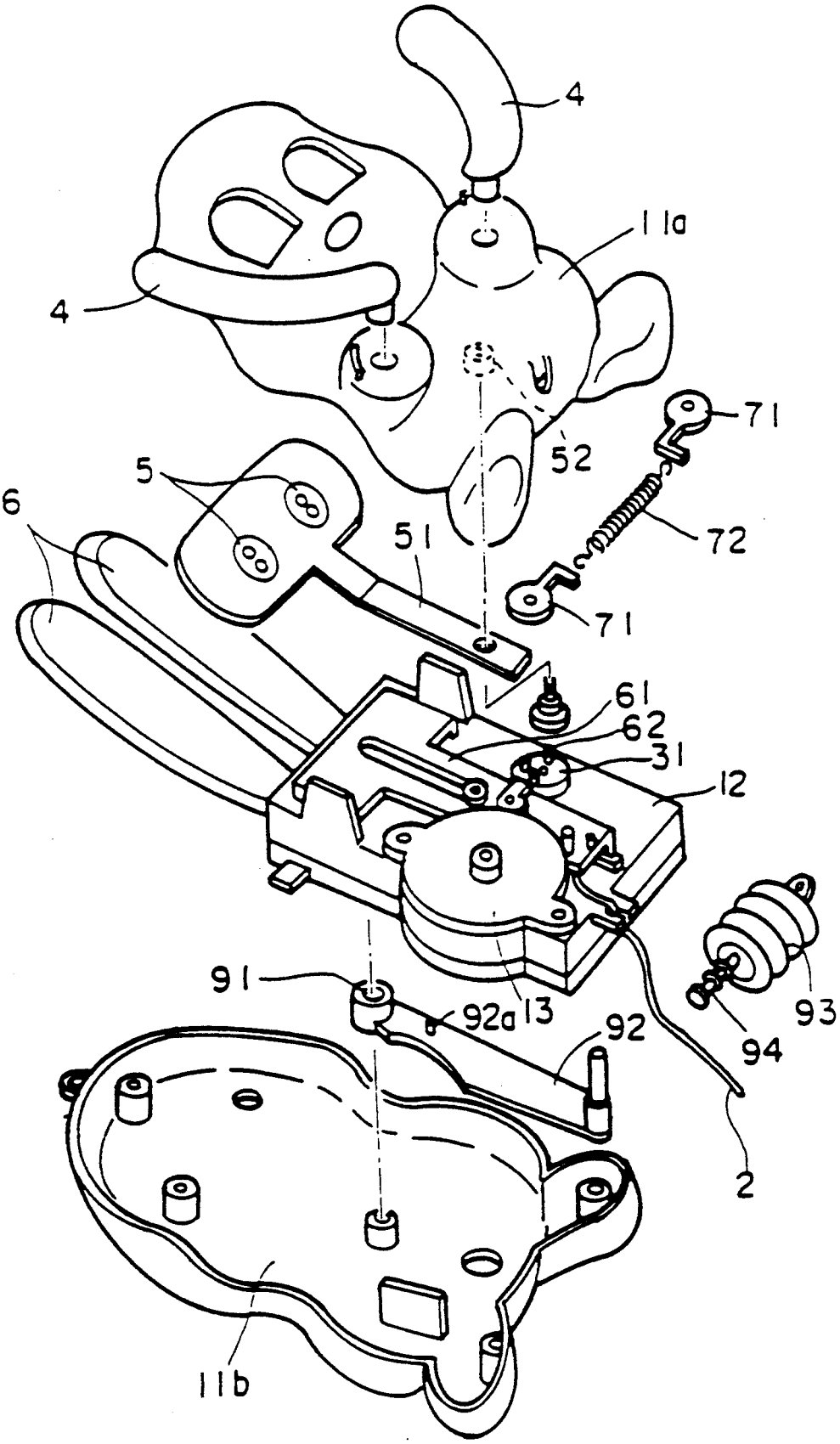
FIG. 2 is an exploded perspective view of the spiral spring toy with a pulling string according to the present invention.
Figure 3:
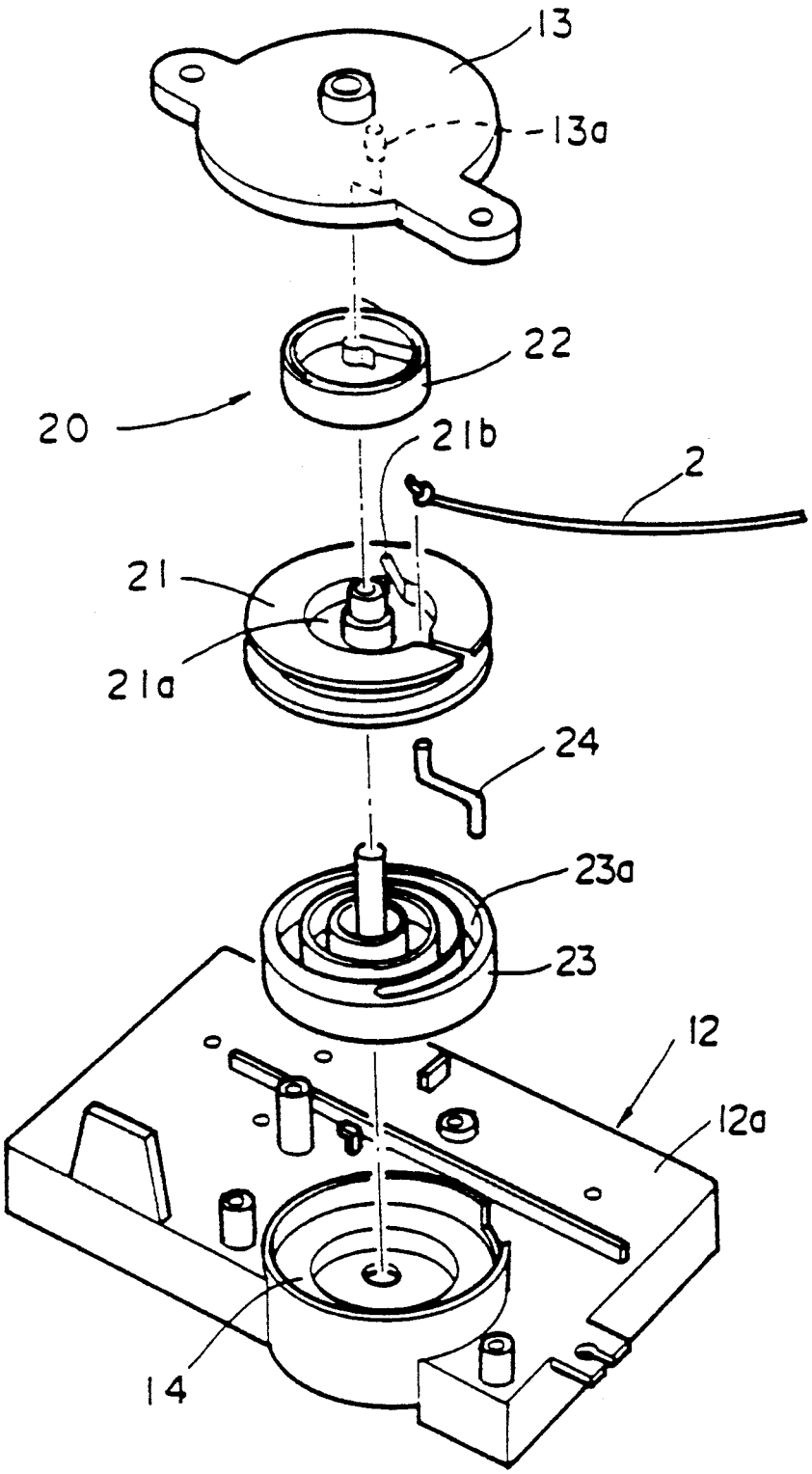
FIG. 3 is an exploded perspective view of a string windup mechanism of a spiral spring toy with a pulling string according to the present invention.

In FIG. 3, a windup mechanism 20 for the pulling string 2 is shown. The windup mechanism 20 includes a string windup pulley (a second turning body) 21 to which a knot formed on an upper end of the string 2 is engaged. A circular concave portion 21*a* provided on an upper surface of this pulley 21 is shaped so as to receive a string windup spiral spring 22. An outer end of the spiral spring 22 is attached to a groove portion 21*b* formed on an inner wall of a concave portion 21*a* and an inner end of spring 22 is attached to a boss 13*a* of a cover body 13. The cover body 13 is attached to a surface of a front case portion 12*a* of a gear box 12 by means of a machine screw as shown in FIG. 2.

Figure 4:
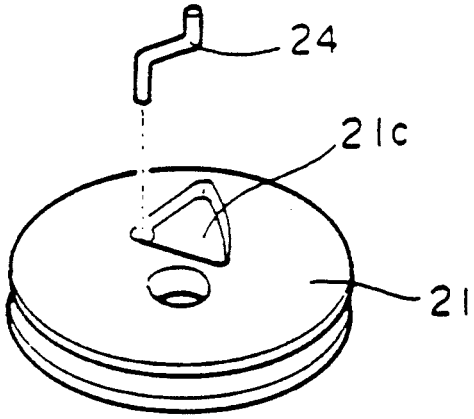
FIG. 4 is a perspective view of a reverse side of a pulley of a spiral toy with a pulling string according to the present invention.

On the underside of the pulley 21, there is provided a clutch board (a first turning body) 23 which is capable of turning integrally with the pulley 21 under a predetermined condition. As shown in FIG. 3, the clutch board 23 is received into a circular concave portion 14 formed on the surface of the front case portion 12*a*. A spiral-shaped guide groove 23*a* is provided within the clutch board 23, and floating within this spiral-shaped guide groove 23*a* is a free end of a crank-shaped floating member 24. As shown in FIG. 4, the outer end of the crank-shaped floating member is inserted into the pulley 21. The crank-shaped floating member pivots within a sector-shaped concave portion 21*c* provided on a lower surface of the pulley 2 and is swingable within a predetermined angle zone.

Figure 6:
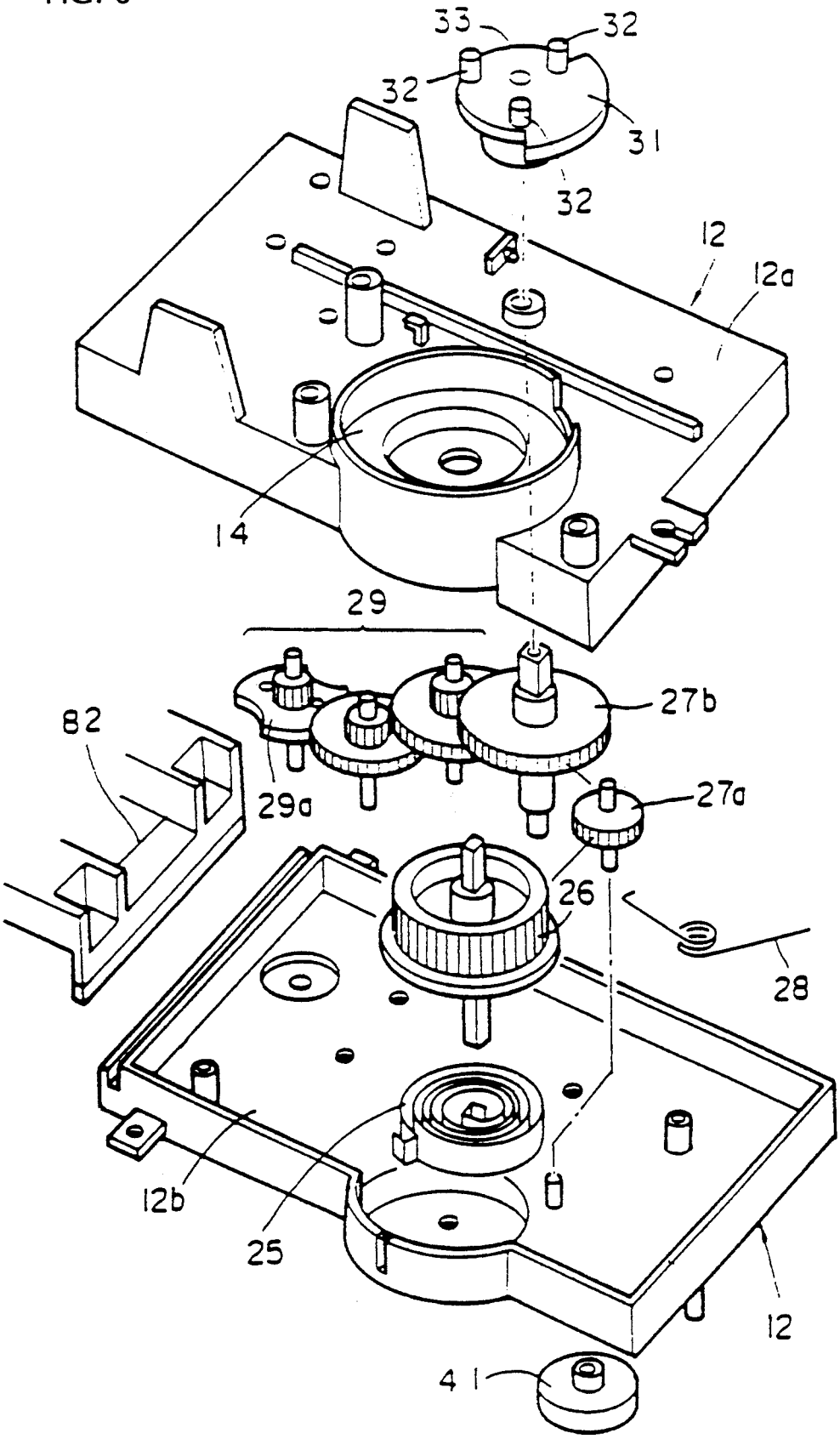
FIG. 6 is an exploded perspective view of a power transmitting mechanism of a spiral spring toy with a pulling string according to the present invention.

When the pulley 21 is rotated in a clockwise direction by the string 2 being pulled, the free end of the floating member 24 contacts with a wall formed at an outer end portion of the spiral-shaped guide groove 23*a*. With this movement, the pulley 21 and the clutch board 23 are integrally rotated and a driving spiral spring (power source) 25 shown in FIG. 6 is charged. The driving spiral spring 25 is fixedly engaged at one end coaxially with the clutch board 23 and at the other end with a notch portion 15 formed on a rear case portion 12*b* of the gear box 12. When the pulley 21 is rotated in a counter-clockwise direction with respect to the clutch board 23, the free end of the floating member 24 floats through and copies the spiral-shaped guide groove 23*a*.

Next, referring to FIG. 6, a driving force transmission path from a charged driving spiral spring 25 is described. The driving force of the driving spiral spring 25 is first transmitted to a motive gear 26 which is assembled coaxially with the spiral spring 25, and then is transmitted from this motive gear 26 through gears 27*a*, 27*b* to a cam 31 which is located outside the front case portion 12*a*. The driving force of the driving spiral spring 25 is also transmitted from the shaft of the gear 27*b* to a positive cam 41 which is located outside the rear case portion 12*b*. When the motive gear 26 is not rotating in a clockwise charging direction, spring 28 forces gear 27*a* into contact with gear 27*b* such that the two gears mesh. The meshing engagement is released when the motive gear 26 is rotated in a clockwise charging direction.

The gear 27*b* is further connected with a speed adjusting mechanism comprising a governor 29*a* and a gear train. With this speed adjusting mechanism 29, a discharging speed of the driving spiral spring 25 can be adjusted. The returning speed of the driving spiral spring 25 is set to be slower than that of the string windup spiral spring 22. As a result, when the string 2 released after it has completed charging, the driving spiraling 25 begins its operation after the string 2 has been rewound by the pulley 21.

The cams 31, 41, and various motion mechanisms will now be described in detail.

Figure 5:
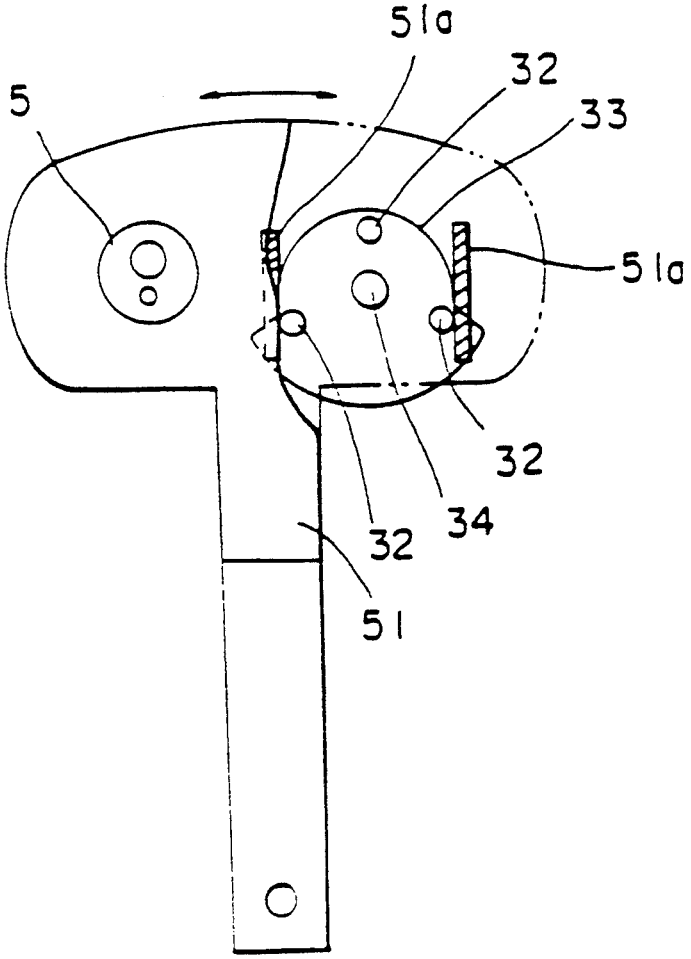
FIG. 5 is a cross-sectional view of a mechanism for moving the eyes of a spiral spring toy with a pulling string according to the present invention.

The cam 31 is provided for actuating the paws 4, the eyes 5, and the ears 6. An eye motion cam portion 32 and a paw and ear motion cam portion 33 are formed on this cam 31, as shown in FIGS. 5 and 6. The cam portion 32 is comprised of three protruding pins provided on the cam 31 at positions offset from the shaft 34 of the cam 31. The cam portion 33 is a plate cam, which includes a smaller radius copying surface and a larger radius copying surface. Although other configurations are possible, the cam 31 of this example turns three times as the driving spiral spring 25 turns one time.

The motion of the eyes 5, which are displayed on a T-shaped swingable plate 51, is actuated by the cam portion 32. The swingable plate 51 is fixed on an inner side of the case 11*a* by means of a machine screw so that the base end portion of the T-shaped swingable plate 51 is fixed at a portion corresponding to a navel. The eyes 5 reciprocate in a right-and-left direction as the swingable plate 51 swings about the navel portion 52. In order for the cam mechanism to perform such a motion, on the underside of the swingable plate 51, there are provided two cam contacting portions 51*a* as shown in FIG. 5. The cam portion 32 is provided between the cam contacting portions 51*a*. The reference numeral 11*b* in FIG. 2 represents a rear case.

The cam portion 33 is positioned so as to be engagable with a hook member 62 which is installed on a slide plate 61. The slide plate 61 is movable in an up and down direction as shown in the exploded view of FIG. 2, the perspective view of FIG. 7, and the cross-sectional view of FIG. 8. The hook member 62 is pressed onto a protruding portion 64 formed on the surface of the slide plate 61 by virtue of a spring force of the restoration spring 63. Hook member 62 is engaged with a stepped portion formed between the smaller radius copying surface and the larger radius copying surface of the cam portion 33. As the cam 3 rotates, hook member 62 moves the slide plate 61 downward as the hook member is pushed downward by the stepped portion and the radius copying surface. Because the hook member 62 does not engage with the smaller radius copying surface of the cam portion 33, the slide plate 61 is restored to its original position by the action of the restoration spring 61 as cam 31 further rotates.

On the lower surface of the slide plate 61, there are provided protruding portions 65 and 66 for positioning a spring 72 which is hung between hooks 71 formed on the base end portions of the paws 4. As a result, when the slide plate 61 is moved in an up and down direction, the paws 4 swing about the base end portion so as to cause an opening and closing motion.

Figure 7:
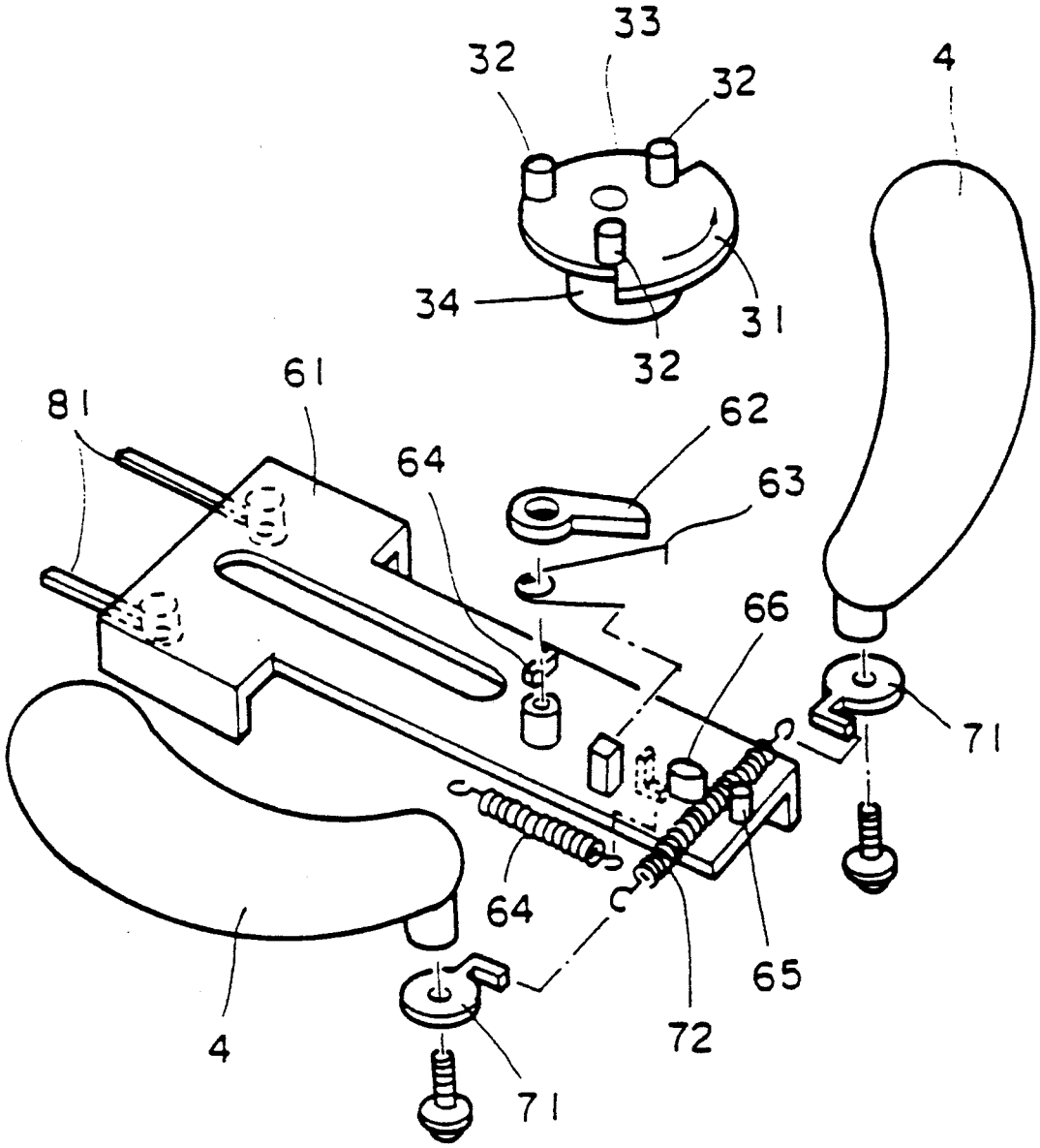
FIG. 7 is an exploded perspective view of a mechanism for moving the paws and ears of a spiral spring toy with a pulling string according to the present invention.
Figure 8:
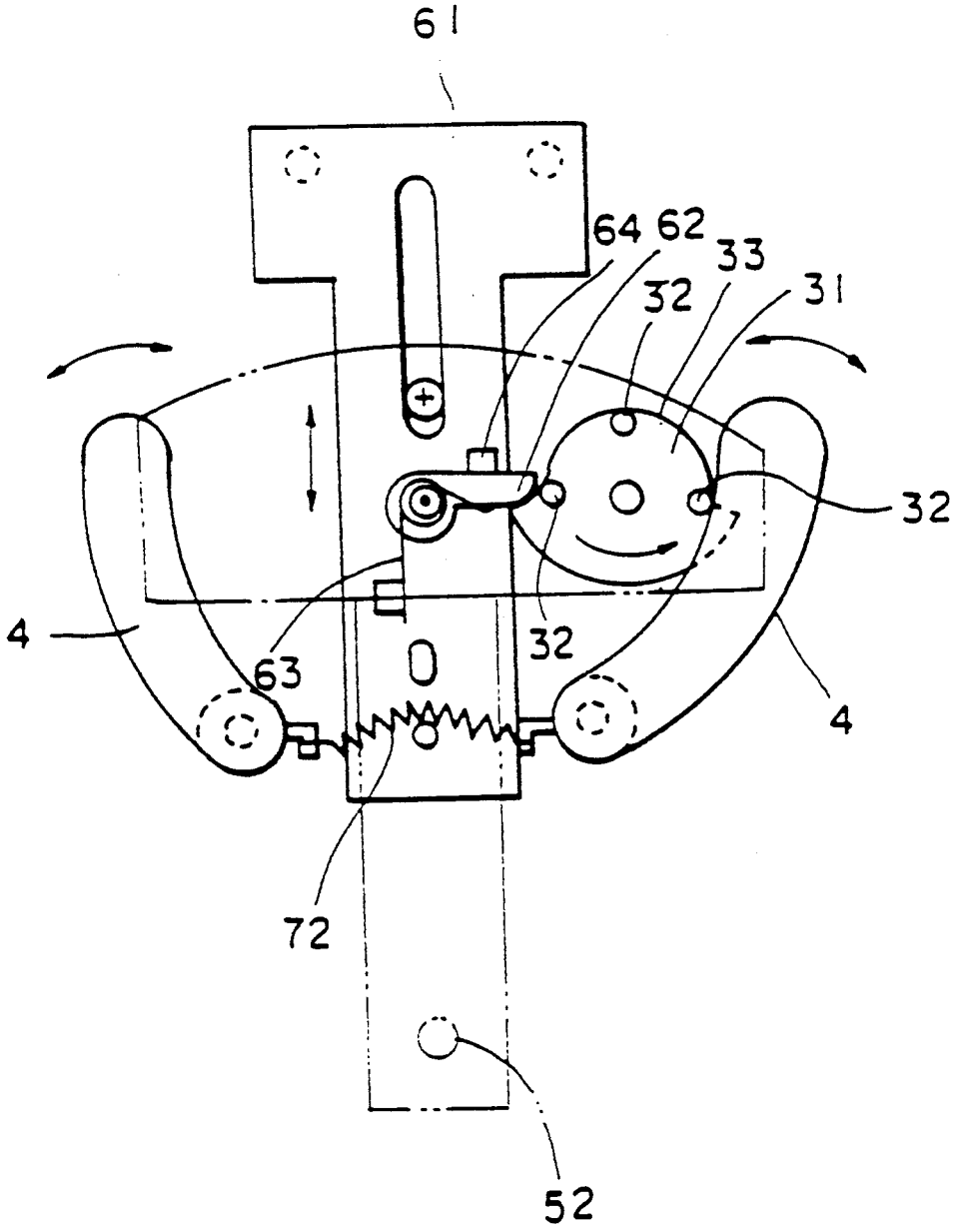
FIG. 8 is a cross-sectional view of a mechanism for moving the paws, eyes, and ears of a spiral spring toy with a pulling string according to the present invention.
Figure 9:
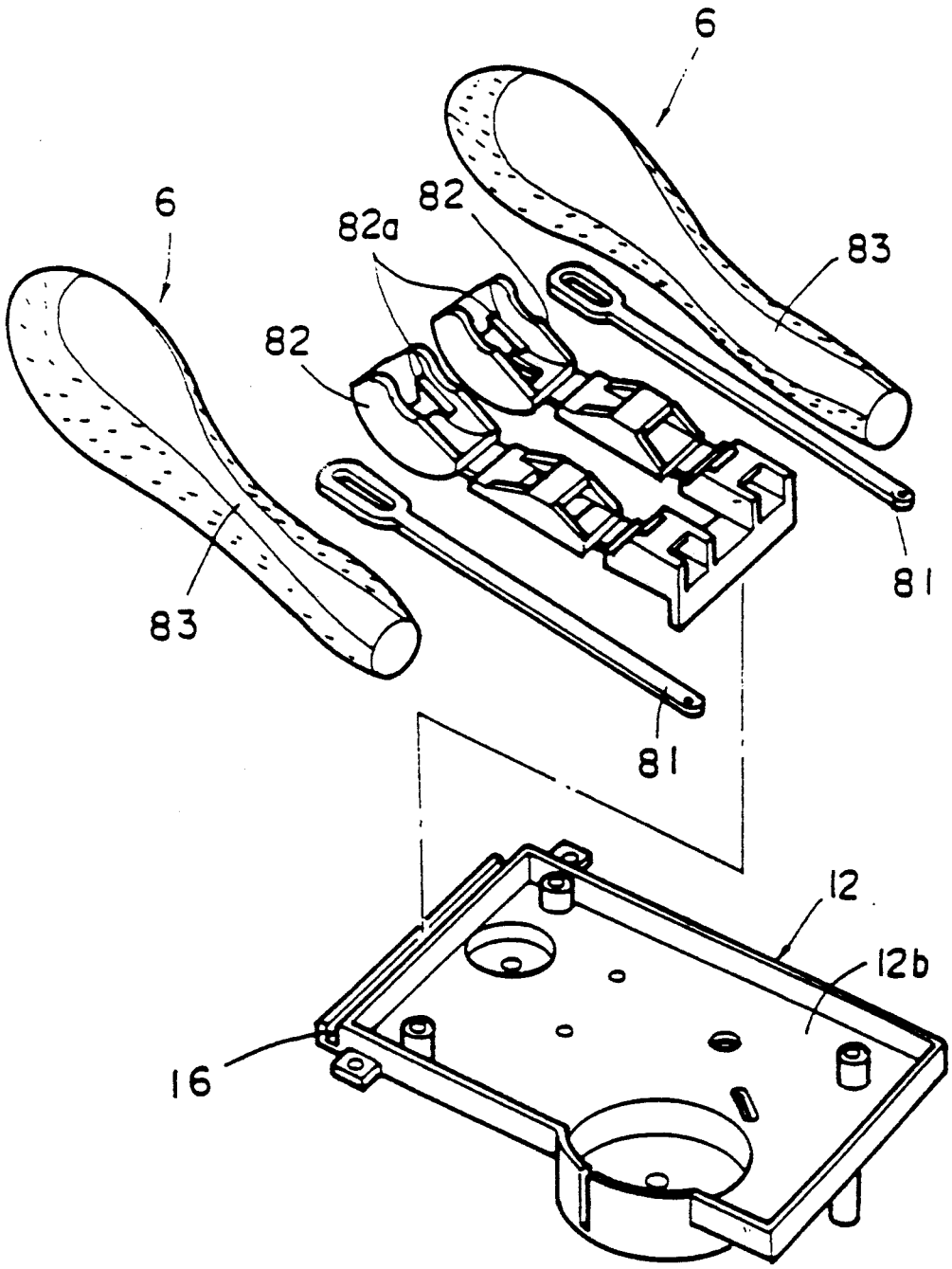
FIG. 9 is an exploded perspective view of a mechanism for moving the ears of a spiral spring toy with a pulling string according to the present invention.

Moreover, at the upper end of the slide plate 61, there is attached a base end of an operation piece 81 for moving the ears 6, as shown in the perspective view of FIG. 7 and the perspective view of FIG. 9. The operation piece 81 is inserted into an ear manipulation member 82, which is foldable inward at a node portion and is integrally made of plastic. The ear manipulation member 82 is fixedly coupled with protruding portion 82*a* formed at a tip end portion of the ear manipulation member 82. The base end portion of the ear manipulation member 82 is fixedly inserted into a groove 16 formed on an upper end of the gear box 12. As a result, the ear manipulation member 82 causes a rising and falling motion of the ears 6 in accordance with an up and down motion of the slide plate 61. The reference numeral 83 in FIG. 9 represents an outer skin of ear.

Figure 10:
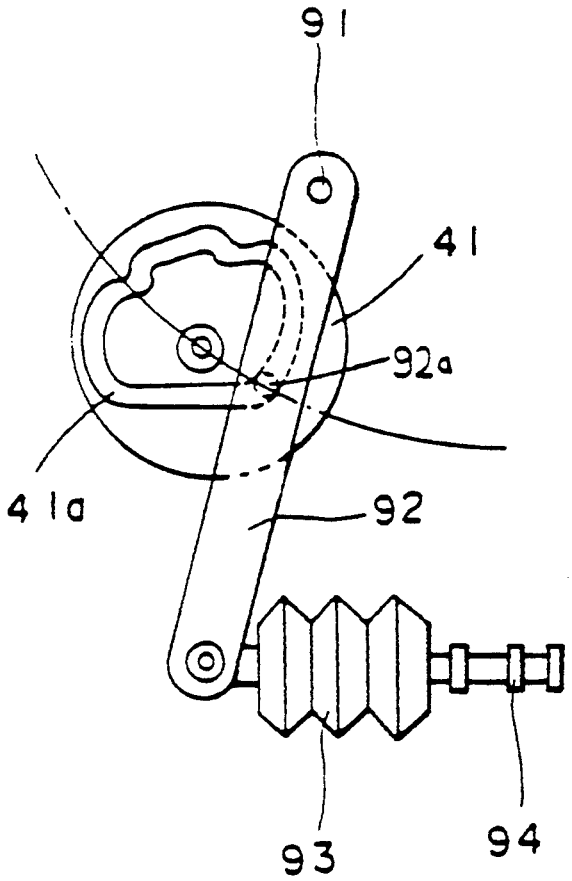
FIG. 10 is a cross-sectional view of a reverse side of a speaking mechanism of a spiral spring toy with a pulling string according to the present invention.

A cam 41 is provided so that the doll body 1 can speak musical sounds. The cam 41 is a positive cam, as shown in a reverse view of FIG. 10. A pin 92*a* protrudes from the surface of a swingable member 92 which is swingable about the axis 91. The pin 92*a* is engaged with a groove 41*a* of the cam 41. One end of a bellows-shaped compressional operation member 93 is installed at a tip end of the swingable member 92. A flute body 94 is installed on the other end of the compressional operation member 93, and the flute 94 makes speaking sounds when the compressional operation member 93 is compressed or expanded in accordance with the swing motion of the swingable member 92.

In accordance with the above-described embodiment of the spiral spring toy with the pulling string, the present invention has the following advantages.

When the string is released after the driving spiral spring 25 has been completely charged, the pulley 21 returns earlier due to the copying motion of the free end of the floating member 24 through the spiral-shaped groove 23*a*. Therefore, with this early return motion, the string 2 is immediately retracted into the doll body 1. Accordingly, it becomes possible to effectively prevent the string 2 from entangling with a part of the baby's body as long as it is surely confirmed that the string 2 is retracted into the doll body 1.

Further, even if, for example, the spiral spring toy with a pulling string is hung from the ceiling, the string 2 is prevented from hanging loosely during operation of the toy. Thus, it no longer obstructs someone passing closely, and it does not detract from the appearance.

Although the present invention is explained based on the above-described embodiment, the invention is not limited to the above-described particular embodiment. Various modifications can be made without departing from the scope of the invention.

For example, although the above embodiment is described based on the hanging-type toy with a pulling string, it can be applied to any spiral spring toy with a pulling string such as a walking toy, a travelling toy, and a music box. And, if the invention is applied to a walking toy or a travelling toy, a further advantage is achieved in that it is no longer necessary to pull the string while the walking toy is walking or the travelling toy is travelling.

Furthermore, in the above-described embodiment, the floating member 24 pivots, making a swinging motion. However, different floating member configurations can be used as long as the floating member floats through and copies the spiral-shaped guide groove 23*a*. For example, the floating member could slide back and forth in a radial direction of the pulley 21.

I claim:

1. A spiral spring toy with a pulling string, comprising:

a driving spiral spring;

a first turning body connected with the driving spiral spring so that the driving spiral spring biases the first turning body in a first rotational direction and rotation of the first turning body in a second rotational direction charges the driving spiral spring;

a pulling string;

a string windup spiral spring;

a second turning body connected with the pulling string and the string windup spiral spring so that the string windup spiral spring biases the second turning body in the first rotational direction and pulling of the pulling string rotates the second turning body in the second rotational direction and charges the string windup spiral spring;

a spiral-shaped guide groove having an end portion and being provided on one of the first and the second turning body;

floating means provided on the turning body not provided with the spiral-shaped guide groove, wherein when the pulling string is pulled, the floating means contacts the end portion of the spiral-shaped guide groove causing the first and second turning bodies to rotate integrally in the second rotational direction and when the pulling string is released, the floating means floats through and copies the spiral-shaped guide groove so that the second turning body is restored before the first turning body and the string windup spiral spring is discharged before the driving spiral spring.

2. A spiral spring toy with a pulling string as claimed in claim 1, wherein the floating means pivots about a point on the turning body provided with the floating means to allow the floating means to float through the spiral-shaped guide groove.

3. A spiral spring toy with a pulling string as claimed in claim 1, wherein the floating means slides in a radial direction on the turning body provided with the floating means to allow the floating means to float through the spiral-shaped guide groove.

4. A spiral spring toy with a pulling string as claimed in claim 1, wherein the spiral spring toy is embodied as a walking toy.

5. A spiral spring toy with a pulling string as claimed in claim 1, wherein the spiral spring toy is embodied as a music box.

6. A spiral spring toy with a pulling string as claimed in claim 1, wherein the spiral spring toy is embodied as a hanging toy.

7. A spiral spring toy with a pulling string as claimed in claim 1, wherein the spiral spring toy is embodied as a traveling toy.

8. A spiral spring toy with a pulling string as claimed in claim 1, wherein the spiral spring toy is embodied as a rabbit.

9. A spiral spring toy with a pulling string as claimed in claim 8, wherein the spiral spring toy has a pair of objects anatomically resembling eyes, the objects being movable back and forth.

10. A spiral spring toy with a pulling string as claimed in claim 8, wherein the spiral spring toy has a pair of paw objects anatomically resembling paws, the objects being movable back and forth covering and exposing a pair of eye objects, anatomically resembling eyes, in a peek-a-boo motion.

11. A spiral spring toy with a pulling string as claimed in claim 8, wherein the spiral spring toy has a pair of ear objects anatomically resembling ears, the ear objects being movable to rise and fall over a head object anatomically resembling a head.

12. A spiral spring toy with a pulling string as claimed in claim 8, wherein the spiral spring toy has sound means for producing musical speaking sounds.

13. A spiral spring toy with a pulling string as claimed in claim 9, further comprising:

a swingable plate for displaying the eyes, the swingable plate having cam contacting portions and an end portion opposite the swingable plate axis of rotation, the cam contacting portions generally located on the end portion;

an actuating cam rotated by the driving spiral spring, the actuating cam having protruding cam portions and being positioned so that rotation of the actuating cam causes the protruding cam portions to selectively contact the cam contacting portions swinging the swingable plate about the swingable plate axis of rotation.

14. A spiral spring toy with a pulling string as claimed in claim 10, further comprising:

an actuating cam rotated by the driving spiral spring, the actuating cam having a plate cam portion, the plate cam portion comprising a smaller radius surface, a larger radius surface and a stepped portion between the smaller radius surface and the larger radius surface;

a slide plate which is slidable back and forth in a first and second direction and spring biased in first direction, the slide plate having a hook member spring biased to protrude from the slide plate and positioned in the vicinity of the actuating cam so that during each rotation of the actuating cam the hook member contacts the step portion and the larger radius surface and does not contact the smaller radius surface, whereby rotation of the actuating cam causes the back and forth motion of the slide plate;

wherein the pair of paws has an outer end and an inner end, each paw being positioned in the vicinity of an opposite side of the slide plate;

a paw operation spring having two ends and a middle region attached to the slide plate, each of the two ends being attached to the inner end one of the two paws so that the sliding of the slide plate moves the outer end of the paws back and forth.

15. A spiral spring toy with a pulling string as claimed in claim 11, further comprising:

an actuating cam rotated by the driving spiral spring, the actuating cam having a plate cam portion, the plate cam portion comprising a smaller radius surface, a larger radius surface and a stepped portion between the smaller radius surface and the larger radius surface;

a slide plate which is slidable back and forth in a first and second direction and spring biased in first direction, the slide plate having a hook member spring biased to protrude from the slide plate and positioned in the vicinity of the actuating cam so that during each rotation of the actuating cam the hook member contacts the step portion and the larger radius surface and does not contact the smaller radius surface, whereby rotation of the actuating cam causes the back and forth motion of the slide plate;

an ear manipulation means for transforming the back and forth motion of the slide plate into a rising and falling motion, the ears being attached to the ear manipulation means.

16. A spiral spring toy with a pulling string as claimed in claim 12, further comprising:

a speech actuating plate cam having an irregularly-shaped groove provided around the speech actuating plate cam axis of rotation;

a swingable member having a pin and an attachment point opposite the swingable member axis of rotation, the pin being positioned between the swingable member axis of rotation and the attachment point, the pin being engaged with the irregularly-shaped groove so that as the speech actuating plate cam rotates the attachment point end of the swingable member swings;

a bellows-shaped chamber having first and second opposite ends, the first end connected to the attachment point so that the bellows-shaped chamber is compressed and expanded by the swingable member;

a flute body connected to the second end of the bellows-shaped chamber so that as the bellows-shaped chamber is compressed and expanded the flute body makes the speaking sounds.

17. A spiral spring toy with a pulling string as claimed in claim 8, further comprising:

a pair of eyes;

a swingable plate for displaying the eyes, the swingable plate having an end portion opposite the swingable plate swingable plate axis of rotation, and cam contacting portions generally located on the end portion;

an actuating cam rotated by the driving spiral spring, the actuating cam having protruding cam portions and a plate cam portion, the plate cam comprising a smaller radius surface, a larger radius surface and a stepped portion between the smaller radius surface and the larger radius surface, the actuating cam being positioned so that rotation of the actuating cam causes the protruding cam portions to selectively contact the cam contacting portions swinging the swingable plate about the swingable plate axis of rotation;

a slide plate which is slidable back and forth in a first and second direction and spring biased in first direction, the slide plate having a hook member spring biased to protrude from the slide plate and positioned in the vicinity of the actuating cam so that during each rotation of the actuating cam the hook member contacts the step portion and the larger radius surface and does not contact the smaller radius surface, whereby rotation of the actuating cam causes the back and forth motion of the slide plate;

a pair of paws having an outer end and an inner end each paw being positioned in the vicinity of an opposite side of the slide plate;

a paw operation spring having two ends and a middle region attached to the slide plate, each of the two ends being attached to the inner end of one of the two paws wherein the sliding of the slide plate moves the outer end of the paws back and forth.

18. A spiral spring toy with a pulling string as claimed in claim 17, further comprising:

a pair of ears which rise and fall over a head;

an ear manipulation means for transforming the back and forth motion of the slide plate into a rising and falling motion, the ears being attached to the ear manipulation means;

a speech actuating plate cam having an irregularly-shaped groove provided around the speech actuating plate cam axis of rotation;

a swingable member having a pin and an attachment point opposite the swingable member axis of rotation, the pin being positioned between the swingable member axis and the attachment point, the pin being engaged with the irregularly-shaped groove so that as the speech actuating plate cam rotates the attachment point end of the swingable member swings;

a bellows-shaped chamber having first and second opposite ends, the first end connected to the attachment point so that the bellows-shaped chamber is compressed and expanded by the swingable member;

a flute body connected to the second end of the bellows-shaped chamber so that as the bellows-shaped chamber is compressed and expanded the flute body makes speaking sounds.

19. A spiral spring toy with a pulling string as claimed in claim 18, wherein the floating means pivots about a point on the turning body provided with the floating means to allow the floating means to float through the spiral-shaped guide groove.

20. A spiral spring toy with a pulling string as claimed in claim 18, wherein the floating means slides in a radial direction on the turning body provided with the floating means to allow the floating means to float through the spiral-shaped guide groove.

* * * * *